US005249307A

United States Patent [19]

Lemoine

[11] Patent Number: 5,249,307

[45] Date of Patent: * Oct. 5, 1993

[54] VENTILATED BEEKEEPER'S SUIT

[76] Inventor: Philip G. Lemoine, 801 Little Farms Ave., Metairie, La. 70506

[ * ] Notice: The portion of the term of this patent subsequent to Jan. 22, 2008 has been disclaimed.

[21] Appl. No.: 567,618

[22] Filed: Aug. 7, 1990

Related U.S. Application Data

[63] Continuation-in-part of Ser. No. 232,674, Aug. 16, 1988, Pat. No. 4,985,933.

[51] Int. Cl.[5] ..... A42B 3/00; A41D 13/00

[52] U.S. Cl. ..... 2/84; 2/4; 2/DIG. 1

[58] Field of Search ..... 2/161 R, 22, 84, DIG. 1, 2/2, 2.5, 2.1 R, 2.1 A, 4

[56] References Cited

U.S. PATENT DOCUMENTS

| | | | |
|---|---|---|---|
| 2,074,390 | 3/1937 | Green | 2/4 X |
| 3,191,185 | 6/1965 | Martin | 2/22 |
| 3,710,395 | 1/1973 | Spano et al. | 2/DIG. 1 X |
| 3,783,451 | 1/1974 | Malin | 2/4 |
| 4,422,184 | 12/1983 | Myers | 2/4 |
| 4,716,594 | 1/1988 | Shannon | 2/4 |
| 4,985,933 | 1/1991 | Lemoine | 2/4 X |

FOREIGN PATENT DOCUMENTS

| | | | |
|---|---|---|---|
| 267858 | 5/1976 | U.S.S.R. | 2/4 |
| 884668 | 11/1981 | U.S.S.R. | 2/4 |

*Primary Examiner*—Clifford D. Crowder
*Assistant Examiner*—Sara M. Current
*Attorney, Agent, or Firm*—Keaty & Keaty

[57] ABSTRACT

The invention relates to a beekeeper's suit which is used for protection against bee stings and insect bites. The beekeeper's suit provides for the use of a multi-layered material from which substantially the entire suit is uniformly constructed. The material includes an outside net layer, an inside net layer and an intermediate porous cellular plastic layer. The inside and outside layers provide structural integrity to the suit, while the intermediate layer provides protection against the bee stings through its thickness of approximately 0.4–0.6 centimeters. The intermediate layer provides about 90–95% of void space with a high degree of permeability to permit ventilation an cooling of the users skin during activity.

7 Claims, 2 Drawing Sheets

VENTILATED BEEKEEPER'S SUIT

CROSS REFERENCE TO RELATED APPLICATIONS

This is a continuation-in-part of my application Ser. No 232,674 filed Aug. 16, 1988 for "Ventilated Beekeeper's Suit" now U.S. Pat. No. 4,985,933, the disclosure which is incorporated by reference herein.

BACKGROUND OF THE INVENTION

The present invention relates to suits for beekeepers and, more particularly, to beekeepers suit which is designed to be used to protect beekeeper's body from bee stings.

In the art of beekeeping it is important to inspect the bee hives or harvest honey which exposes the beekeeper to close contact with hundreds of bees which, when feel threatened, may sting the beekeeper. To protect the body of the beekeeper, a plurality of various garments have been designed which generally protect the exposed arms, torso, legs of the beekeeper by covering them with a body suit. However, most of the body suits known heretofore have been constructed of tightly woven material, so as to prevent the bee stings from penetrating through the fabric and reaching the body of the user. The disadvantages of such type of suit are easily appreciated when considering that a beekeeper often has to work in a hot climate when the outside temperature is uncomfortably hot and the body suit constructed of the tightly woven material doesn't allow air to freely circulate to the skin of the user, which leads to overheating of the body and setting of early fatigue. Additionally, the physical activity causes the body to warm up, and since there is no air circulation, the body heat is not allowed to escape.

Therefore there is a constant need in the art for a beekeeper's suit which has the ability to protect the wearer from bee stings while working with the bee hives, yet at the same time provide for ventilation through the suit so that the beekeeper could be kept dry and comfortable during his work.

Various solutions have been offered to solve these problems, one of the known solutions being a beekeeper's suit described in U.S. Pat. No. 3,783,451 issued on Jan. 8, 1974 (Malin). Malin teaches provision of a retaining layer (netting) to which tubes or plastic rings are fixedly secured. However, the suit of Malin is not flexible enough to permit unencumbered movements to the wearer. Additionally, the spaces between tubes or rings have a very thin netting which, when the garment is bent during regular use, will not protect the wearer from insect bites. Further, sagging of netting between the tubes will inevitably expose the user to insect bites.

Another insect protection garment design is disclosed in U.S. Pat. No. 4,716,594 issued on Jan. 5, 1988 (Shannon). This patent discloses a garment made of two layers of fabric which are connected at the seams. The outer layer is a fine mesh netting, while the inner layer is a coarse mesh netting with large openings. The yarns utilized for manufacture of the inner layer are 2/16 of an inch to 7/16 of an inch thick. Shannon teaches that the thickness of the inner layer provides a spacer layer to space the skin of the wearer from the outer layer. However, the thick yarns which closely resemble ropes in thickness might feel rather uncomfortable to a user, especially when bending or flexing arms, and therefore may encumber movements of the beekeeper.

The present invention contemplates elimination of the drawbacks associated with the known solutions by providing a lightweight ventilated beekeeper's suit for protection against insect bites.

SUMMARY OF THE INVENTION

The present invention achieves its objects and overcomes deficiencies of the prior art by providing a beekeeper's suit which is made of a multi-layered material. The outside layer is a netting of flexible material having openings in the range of the between 0.2–1 centimeters per opening. The inside layer is similar to the outside layer in structure. "Sandwiched" between the outside and the inside layer is an intermediate layer formed from a flexible porous cellular plastic material approximately 0.5 cm thick with a pore count in the range of 7–30 pores per linear inch, and a porosity of 97% of void. The intermediate layer is continuous throughout the suit, so that the multi-layered material is uniform, flexible, allowing prevention against insect stings, while permitting air circulation between the body of the user and the exterior of the suit to make the beekeeper more comfortable during active work.

In one of the embodiments, the present invention provides for the suit covering substantial entire body of the user and includes an upper torso portion, arm portions secured to the upper torso portion about the shoulder lines, lower torso portion, including leg portions secured to the upper torso portion about the waist line and a hood portion secured to the upper torso portion by zippers or other attachment means one on each side about the neck line. A facial mask formed from mesh material is preferably colored in white or lighter color on the exterior surface thereof, so as to not attract bees or other insects and colored black on interior surface to prevent light reflection and thus increase visibility. The present invention also provides for the use of gloves to be positioned on hands of the user, with the gloves having a cutout portion in which a discrete piece of the material from which the entire suit is constructed is inserted, so as to provide ventilation to the outside surface of the hands and permit further ventilation to the body.

Tightening hook and loop fasteners, elastic, or cords about wrists and ankles of the suit allow tight securing of the arm and legs portions, respectively, so as not to allow insects to penetrate under the suit. The screened mesh facial portion is formed from a mesh having about 0.3 centimeter openings to allow observation of the outside conditions, and not allow bees or other insects to penetrate or sting through.

At the portions where the fabric is engaged in seams, such as about sleeve and pants cuffs, shoulder lines, neckline or waistline, twill or bias tape is sewn to reinforce the area and afford extra protection against stings.

It is therefore an object of the present invention to provide a beekeeper's suit which is lightweight and comfortable to use.

It is a further object of the present invention to provide a beekeeper's suit which is flexible and doesn't impede movements of the user.

It is a further object of the present invention to provided a beekeeper's suit which allows ventilation of the body by permitting air flow to circulate between the body of the user and the exterior and also allows body heat to escape.

It is still a further object of the present invention to provided a beekeeper's suit constructed of multi-layered uniform flexible material, providing uniform protection throughout the surface of the suit.

These and other objects of the present invention will be more apparent to those skilled in the art from the following detailed description of the invention.

BRIEF DESCRIPTION OF THE DRAWINGS

For a further understanding of the nature and objects of the present invention, reference should be had to the following detailed description, taken in conjunction with the accompanying drawings, in which like parts are given like reference numeral, and wherein.

DETAILED DESCRIPTION OF THE PREFERRED EMBODIMENT

Figure 1:
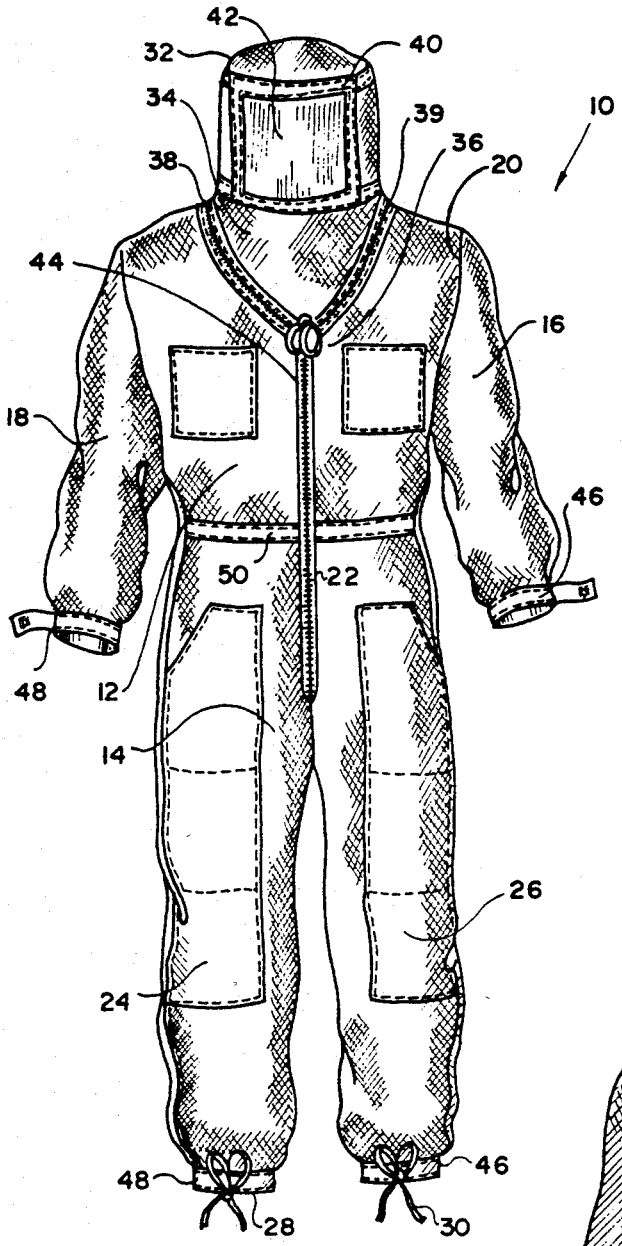
FIG. 1 is a perspective view of the preferred embodiment of the beekeeper's suit of the present invention.

Referring to the drawings in more detail, numeral 10 designates the preferred embodiment of the suit of the present invention. As can be seen in the drawing, the beekeeper suit 10 comprises a body suit having an upper torso portion 12, a lower torso portion 14, the upper torso portion having arm portions 16 and 18 attached thereto along the shoulder seams 20, while the lower torso portion comprises leg portions 24 and 26 extending from the waist line 50 downwardly to the ankle lines 28 and 30, respectively.

A hood portion 32 is sized and shaped to comfortably cover the head of the user, while extending downwardly to a neck portion 34 and attached to the upper torso portion 12 along the neck line 36.

If desired, the hood portion 32 can be attached to the upper torso portion 12 by two zippers 38 which begin in the center rear of neck and close at center front at the chest, and extend along the neck line 36 as illustrated in FIG. 1. The hood can be easily removed.

The hood portion 32 includes a facial mask 40 which is preferably constructed of an open wire mesh, so that the wearer could easily observe his operations during activities about the bee hives. The present invention contemplates the screen 42 to be formed of a screen mesh, with inner surface being painted in darker colors to make observations easier with no light reflection while the outer surface is painted in white color as white does not attract insects, which improves vision without insects in view and also reflects light and heat. The wire mesh screen has open holes of approximately 0.3 centimeter square holes, which size is deemed to be sufficient to prevent penetration through the wire by bees or other insects.

Centrally located about the central line 22 of the upper torso portion 12 and the lower torso portion 14 is an elongated zipper 44 which extends from the neck line 36 to the distance below the waist of the user, so as to permit easy access and exit from the garment 10.

As was mentioned above, the upper torso portion 12 and the lower torso portion 14 are fixedly connected about the waist line 50 to each other or may by a continuous piece for upper and lower portions.

The arm portions 16 and 18 terminate at the wrist portions 46 and 48, respectively which can be provided with hook and loop fasteners , elastic bands or other similar securing means to allow tight enclosure of the arm portions 16 and 18 about the wrists of the user. In a similar manner, the ankle seams 28 and 30 can be provided with hook and loop fasteners or with draw cord tying straps to allow tightening of these portions about the ankles of the user to prevent access of the bees and insects through the space between the body of the user and the fabric of the suit.

The gloves 70 (illustrated in FIG. 7) can be used in combination with the body suit 10, as will be described below.

Figure 6:
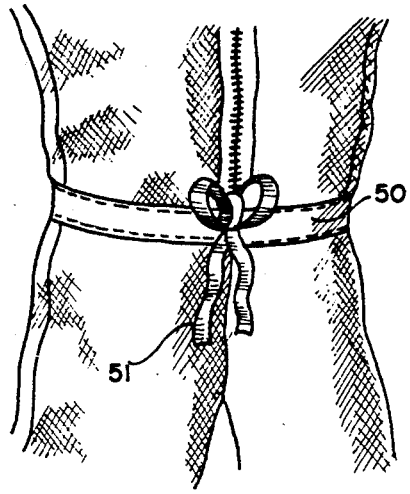
FIG. 6 is a detail view of an alternative jacket embodiment of the present invention.
Figure 2:
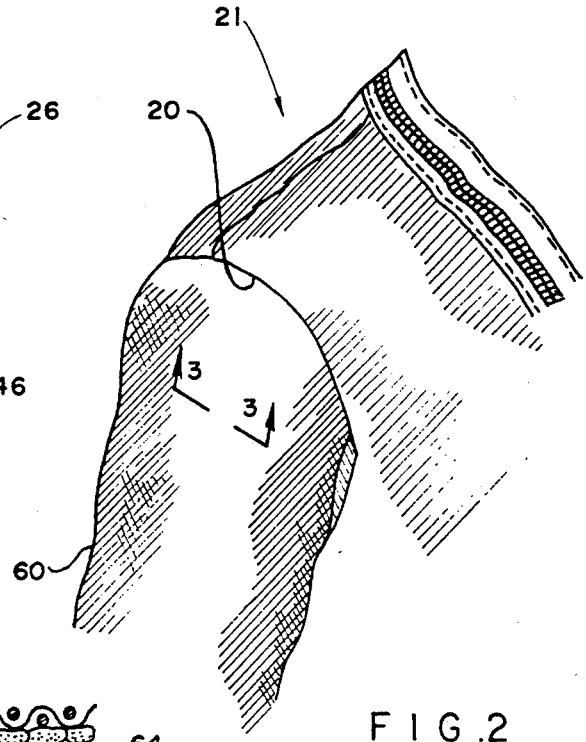
FIG. 2 is a detail view of a portion of the beekeeper's suit of the present invention.

FIG. 6 illustrates an alternative embodiment of the present invention, wherein the beekeeper's suit is in the form of a jacket which extends from the neck of the user (not shown) to the waist of the beekeeper. Secured about the waistline 50 is a draw cord or string 51 which is tied at the waist to tighten the jacket about the body of the beekeeper. A conventional elongated zipper may be provided through the central front line of the jacket to close the garment in a conventional manner. The jacket may be used by the beekeeper when making short inspections of the bee hives.

Figure 3:
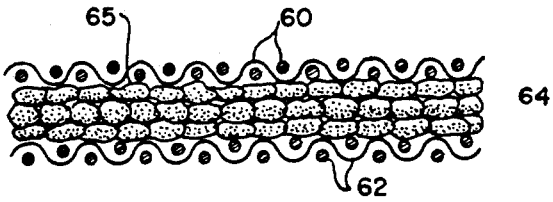
FIG. 3 is a cross-sectional along lines 33 in FIG. 2, and typical make up of suit.
Figure 4:
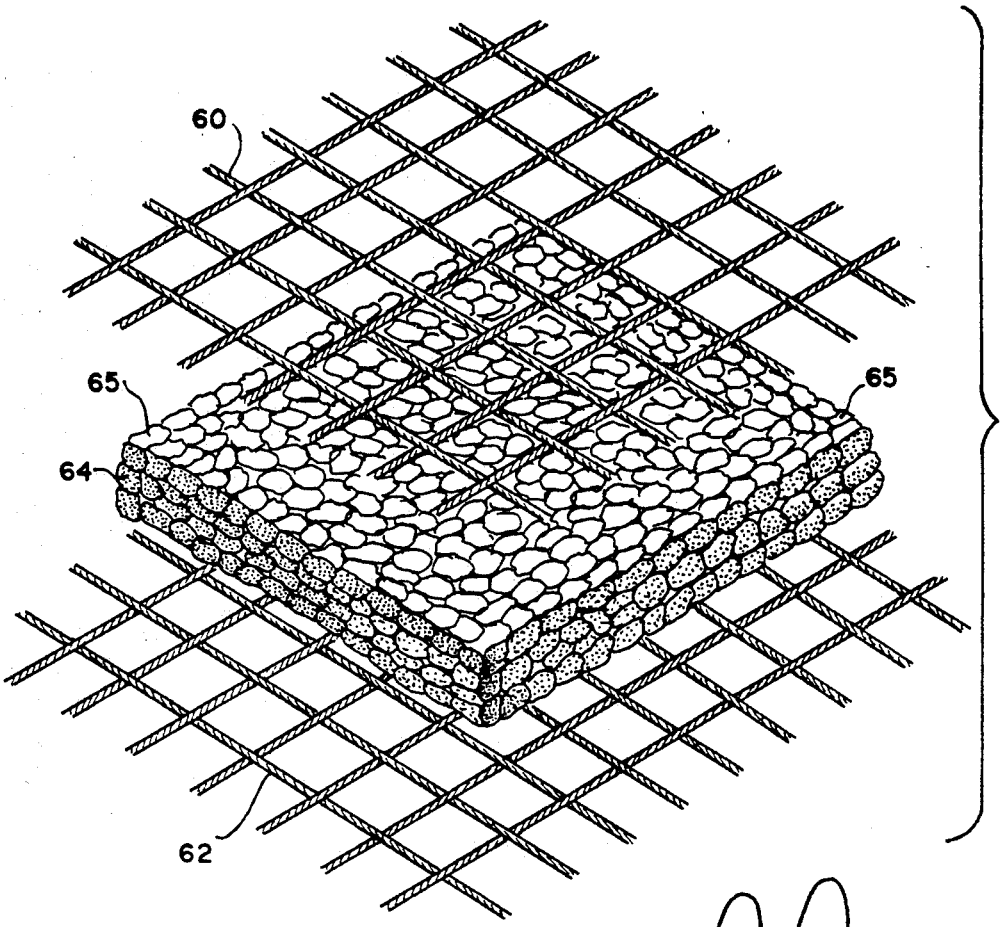
FIG. 4 is an exploded view of the multi-layered fabric structure from which the suit of the present invention is constructed, using square netting for inner and outer material.

Turning now to FIGS. 3 and 4, the fabric construction from which the suit 10 is made will be now discussed. As seen in FIG. 3, the fabric comprises an outside netting layer 60, an inside netting layer 62 and an intermediate porous layer 64. The layers 60 and 62 are similar in construction and are formed of net mesh having a pore count in the range of 0.2–1 centimeters per opening. The shape of the open holes can be made square, round or, in the alternate FIG. 5 netting, hexagonal with a thickness of approximately 0.05–0.07 centimeters.

This fine net material is comfortable to the skin of the user and extends throughout the garment construction, presenting no obstructions which might irritate the skin of the beekeeper. The suit 10 can be worn with or without undergarment to allow for better ventilation of the beekeepers body.

The intermediate layer 64 is made from a porous material, such as flexible porous cellular plastic having a porosity grade in the order of 10, with 7–30 pores per linear inch variance, and having a porosity of 97% of void. The individual open pores 65 allow a complete flow of air through the layer 64 from the outside onto the skin of the user or from the skin of the user to the outside, allowing escape of the body heat. Since the outside layer 60 and the inside layer 62 are open net layers, a maximum circulation of air and therefore ventilation of the body is afforded.

The intermediate layer 64 is preferably to be 0.2–0.6 centimeters in thickness and can be as high as 1.2 centimeters in thickness. The overall thickness of the fabric which includes the outside layer 60, intermediate layer 64 and the inside layer 62 is in the order of 0.25–0.8 centimeters thickness overall which effectively prevents penetration of a bee sting through the multi-layered fabric.

The intermediate layer 64 extends uniformly through the entire garment between the outside layer 60 and inside layer 62, so that a uniform flexible material is used throughout the suit to afford a continuous spacing and protective barrier against insects stings. The fabric is therefore flexible, uniform in construction and provides sufficient ventilation for the beekeeper.

Figure 5:
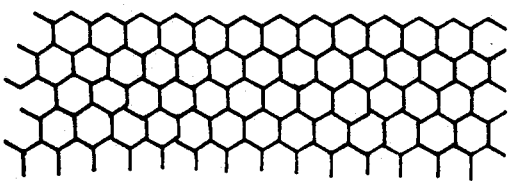
FIG. 5 is a top view of the alternate hexagonal netting for outer or inner layer of the fabric used in constructing the suit of the present invention.

As illustrated in FIG. 5, the layer 60 (or a similar layer 62) can be made from a fabric having hexagonally-shaped openings, such as for example material manufactured by Apex Mills Corporation, style NH43. The outside layer 60 and the inside layer 62 provide structural stability and integrity to the intermediate layer 64 and, therefore, to the overall suit. The small openings of the outside and inside layers provide structural integrity to the intermediate layer 64, protecting it and preventing its tearing or destruction during manipulation of the suit.

Additionally, the staggered open cells 65 of the intermediate layer 64 allow sufficient thickness to the suit to be much less vulnerable to stings than is found in the present state of the art, since it was observed that the insect stinger is less likely to follow the slightly staggered pores from the outside of the suit to the skin of the user. At the same time, the uniform thickness of the intermediate layer provides a constant distance barrier to the insect from the outside of the fabric to the wearer's skin.

The intermediate layer 64 is made from a flame retardant cellular plastic, so as to reduce its flammability. The outside layer 60 and inside layer 62 are also flame retardant and reduces its flammability. The flexible porous cellular plastic layer 64 presents 97% of void space with a very high degree of permeability.

Figure 7:
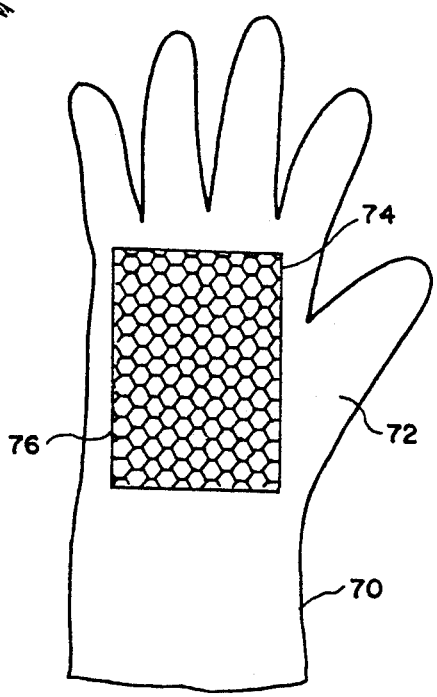
FIG. 7 is a perspective view of a glove used in combination with a certain discrete piece of multi-layered uniform flexible material, sewn on the back of glove, same as used in the garment covering the body of the user in accordance with the present invention.

Referring now to FIG. 7, 70 is shown for use with the suit of the present invention. The glove 70 has an outer side 72 which is provided with a cutout section 74 on back of glove. Sewn within the cutout section 74 is a certain small piece of multi-layered fabric 76 which is identical to the fabric from which the overall garment is composed. The piece 76 has a similar 3-layer composition, with an outside layer similar to the layer 60, inside layer similar to the layer 62 and an intermediate layer similar to the layer 64. The glove 70 allows ventilation of body heat through the cutout portion 74, further increasing comfort of wearing the body suit 10. The cutout 74 is formed only in the outer or back side of the glove 70. This section 76 also prevents insect stings to penetrate the skin.

Many changes and modifications can be made within the embodiment of the present invention without departing from the spirit thereof. I therefore pray that my rights to the present invention be limited only by the scope of the appended claims.

I claim:

1. A ventilated suit for protection against insect bites, the suit comprising an integral suit body formed of substantially uniform flexible multi-layered material, wherein said material comprises:

a first outside net fabric layer;

a second inside net fabric layer; and an intermediate layer of flexible porous material positioned intermediate the first and second layers for defining a thickened protection barrier against insect stings, and wherein the outside, inside and intermediate layers in composite provide a uniformly thick and flexible material allowing air ventilation, said suit body comprising an upper torso portion, a lower torso portion and a hood portion integrally connected to each other, said hood portion being provided with a facial mask opening and a mesh screen secured within said opening, said screen having an outer surface and an inner surface, and wherein said outer surface of the screen is lighter in color than the inner surface of the screen.

2. A ventilated beekeeper's suit for covering at least an upper torso of the user, the suit comprising:

an upper torso portion being formed from a substantially uniform flexible multi-layered material having a uniform thickness and comprising a first outside net layer having a pore count in the range of 0.2–1 centimeters per opening;

a second net layer having a pore count in the range of 0.2–1 centimeters per opening;

an intermediate layer of flexible porous cellular plastic material having a pore count in the range of approximately 7–30 pores per linear inch; and wherein the outside layer, the inside layer and the intermediate layer define a multi-layered composite material for protecting a beekeeper from stings, while allowing air ventilation between exterior of the suit and skin of the wearer.

3. The ventilated beekeeper's suit of claim 2, wherein said intermediate layer serves as a continuous protective barrier against bee stings.

4. The device of claim 3, wherein said material provides for stability of the suit while allowing flexibility of movements to the user.

5. The ventilated beekeeper's suit of claim 3, further comprising a lower body portion and a hood portion.

6. The suit of claim 2, further comprising a pair of gloves, each glove having an interior side and an exterior side, and wherein the exterior side is provided with a cutout portion, in which a discrete piece of multi-layered uniform flexible material is inserted.

7. A ventilated beekeeper's suit for covering at least an upper torso of the user, the suit comprising:

an upper torso portion being formed from a substantially uniform flexible multi-layered material having a uniform thickness and comprising a first outside net layer having a pore count in the range of 0.2–1 centimeters per opening;

a second net layer having a pore count in the range of 0.2–1 centimeters per opening;

an intermediate layer of flexible porous cellular plastic material having a pore count in the range of approximately 7–30 pores per linear inch, wherein the outside layer, the inside layer and the intermediate layer define a multi-layered composite material for protecting a beekeeper from stings, while allowing air ventilation between exterior of the suit and skin of the wearer, said intermediate layer serving as a continuous protective barrier against bee stings, said suit further comprising a lower body portion and a hood portion, and wherein said hood portion is provided with a facial mask screen having an interior surface and an exterior surface, and wherein said exterior surface is of a lighter color than the interior surface.

* * * * *